US007147572B2

(12) United States Patent
Kohno

(10) Patent No.: US 7,147,572 B2
(45) Date of Patent: Dec. 12, 2006

(54) WOOD TYPE GOLF CLUB HEAD

(75) Inventor: Masaru Kohno, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/720,153

(22) Filed: Nov. 25, 2003

(65) Prior Publication Data

US 2004/0162156 A1 Aug. 19, 2004

(30) Foreign Application Priority Data

Nov. 28, 2002 (JP) ..... 2002-346168

(51) Int. Cl.
*A63B 53/04* (2006.01)

(52) U.S. Cl. ..... 473/314; 473/330; 473/345; 473/350

(58) Field of Classification Search ..... 473/314, 473/345, 330, 349
See application file for complete search history.

(56) References Cited

U.S. PATENT DOCUMENTS 4,432,549 A * 2/1984 Zebelean ..... 473/346
5,348,777 A * 9/1994 Oonuki et al. ..... 428/34.5
5,851,160 A * 12/1998 Rugge et al. ..... 473/349
6,093,115 A * 7/2000 Murtland et al. ..... 473/330
6,402,639 B1 * 6/2002 Iwata et al. ..... 473/330
6,458,043 B1 * 10/2002 McCabe et al. ..... 473/330
6,582,323 B1 * 6/2003 Soracco et al. ..... 473/342
6,623,377 B1 * 9/2003 Evans et al. ..... 473/342
6,776,723 B1 * 8/2004 Bliss et al. ..... 473/291
6,783,466 B1 * 8/2004 Seki et al. ..... 473/345

FOREIGN PATENT DOCUMENTS

JP 06-343721 A 12/1994
JP 09-192269 A 7/1997
JP 09-271545 A 10/1997
JP 11-267251 A 10/1999
JP 2001-231897 A 8/2001

* cited by examiner

*Primary Examiner*—Stephen Blau
(74) *Attorney, Agent, or Firm*—Birch, Stewart, Kolasch & Birch, LLP

(57) ABSTRACT

The invention provides a wood type golf club head, wherein in a measuring state where a center line of a shaft axis arranged within a vertical plane and is inclined at a set lie angle, and a face angle is set to zero, a distance (d) of center of gravity corresponding to a shortest distance between the center line of the shaft axis and a center of gravity (G) of the head is between 45 and 50 (mm), and a point (T) on which a horizontal tangential line passing through an area center of gravity (FC) of the face surface and being in contact with the face surface intersects a perpendicular line dropped to the tangential line from a sweet spot (SS) is arranged on the tangential line within 2 (mm) from the area center of gravity FC close to a toe, and within 4 (mm) close to a heel.

14 Claims, 9 Drawing Sheets

CROSS SECTION

WOOD TYPE GOLF CLUB HEAD

This Nonprovisional application claims priority under 35 U.S.C. § 119(a) on Patent Application No. 2002-346168 filed in Japan on Nov. 28, 2002, the entire contents of which are hereby incorporated by reference.

FIELD OF THE INVENTION

The present invention relates to a wood type golf club head which can improve an directionality of a hit ball.

DESCRIPTION OF THE PRIOR ART

A golfer having a comparatively inexperienced skill such as a beginner, an intermediate golfer or the like tends to hit a slice spin ball at a time of hitting the ball by a wood type golf club such as a driver or the like. It can be considered that this is approximately because of the following reasons.

(1) Contact with a ball in a state in which a face is open (FIG. 10A)

(2) Cut hitting (so-called outside in swing track) FIG. 10B)

(3) Gear effect caused by hitting a ball by a heel side of the face (FIG. 10C)

As a method of preventing the slice spin of the hit ball, there has been proposed a method of making a distance of center of gravity of the head small. Accordingly, it is possible to improve a turn of the head during the swing, and it is possible to prevent the face from being opened at a time of hitting the ball. As mentioned above, in conventional, in order to improve the turn of the head, it has been considered that it has been effective to make a moment of inertia of the head around a center line of a shaft axis small.

The inventors of the present invention give the inexperienced golfers a lot of ball hitting tests, and check a pattern of the swing and a change of the face angle during the swing. As a result, it is found that the face is opened contrary to our expectation at a time of impact in the head having a small distance of center of gravity. This is an absolutely contrary result to the conventional forecast. Making further repeated experiments, the inventors have found that the slice spin can be reduced by suitably making a connection of the distance of center of gravity of the head with a position of a sweet spot.

SUMMARY OF THE INVENTION

As mentioned above, a main object of the present invention is to provide a wood type golf club head which can improve a directionality of a hit ball.

In accordance with a first aspect of the present invention, there is provided a wood type golf club head, wherein in a measuring state where a center line of a shaft axis is arranged within a vertical plane and is inclined at a set lie angle, and a face angle is set to zero, a distance d of center of gravity corresponding to a shortest distance between the center line of the shaft axis and a center of gravity G of the head is between 45 and 50 mm, and a point T on which a horizontal tangential line passing trough an area center of gravity FC of the face surface and being in contact with the face surface intersects a perpendicular line dropped to the tangential line from a sweet spot SS is arranged on the tangential line within 2 mm from the area center of gravity FC close to a toe, and within 4 mm close to a heel.

In this case, when an edge of the "face surface" can be specified by a visual observation such as a clear ridge line, the "face surface" is defined as a portion surrounded by the ridge line. However, when the edge of the face surface is not clear, it is defined by the following manner. First, as shown in FIG. 8A, the head is cut by a lot of planes E1, E2 . . . including a liner connecting the center of gravity G of the head and the sweet spot SS. Next, as shown in FIG. 8B, a position Pe at which a radius r of curvature of an outer profile line Lf is equal to or less than 200 mm as seen from a center side of the face surface, in each of cross sections is defined as a boundary. An area surrounded by this position Pe forms the face surface. In this case, the face outer surface profile line Lf is defined by bridging the scorelines or the like.

Further, it is desirable that the distance d of the center of gravity is between 47 and 48 mm and a head volume is equal to or more than 300 $cm^3$.

DESCRIPTION OF THE PREFERRED EMBODIMENTS

A description will be given below of an embodiment in accordance with the present invention with reference to the accompanying drawings.

Figure 1:
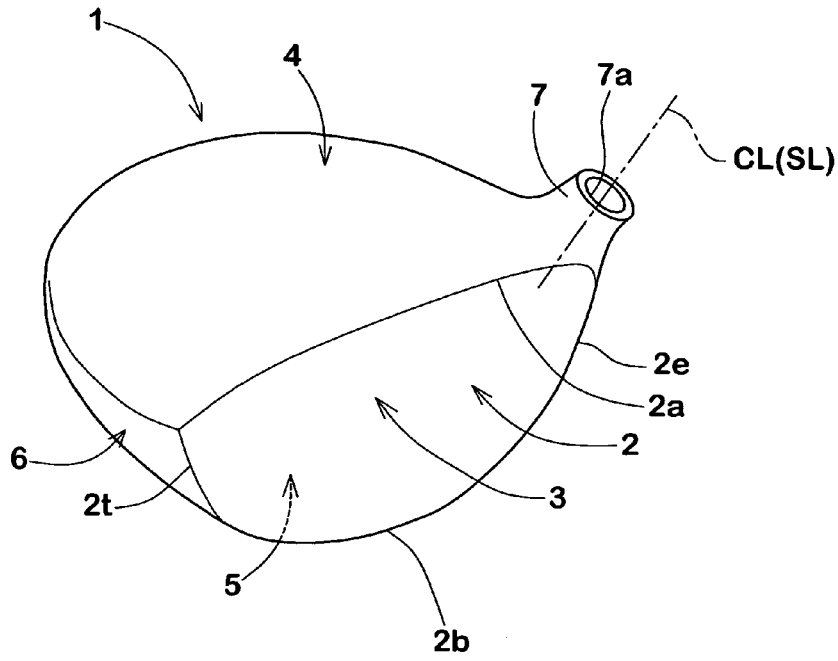
FIG. 1 is a perspective view showing a head in accordance with an embodiment of the present invention.

In FIG. 1, there is exemplified a driver, as a wood type golf club head (hereinafter, sometimes referred simply as "head") 1 in accordance with the present invention. The wood type golf club does not mean a golf club in which a head is formed by a wooden material, but means a concept including a head which has been conventionally formed by the wooden material. This golf club includes at least a driver, a plassie, a spoon, a baffy, and a cleek.

The head 1 comprises a face portion 3 defining a face surface 2 hitting a ball, a crown portion 4 connected to an upper edge 2*a* of the face surface 2 and forming a head upper surface, a sole portion 5 connected to a lower edge 2*b* of the face surface 2 and forming a head bottom surface (the sole portion 5 is invisible in FIG. 1), a side portion 6 between the crown portion 4 and the sole portion 5 and extending from a toe side edge 2*t* of the face surface 2 through a back face to a heel side edge 2*e* of the face surface 2, and a neck portion 7 to which one end of a shaft (not shown) is attached.

A cylindrical shaft insertion hole 7*a* is formed in the neck portion 7. The shaft is inserted to the shaft insertion hole 7*a* in a state of aligning axial center lines. Accordingly, an axial center line CL of the shaft insertion hole 7*a* substantially coincides with a shaft axis center line (SL). In the present specification, the axial center line CL of the shaft insertion hole 7 is substituted for the shaft axis.

The head 1 can be formed, for example, by employing an aluminum alloy, a titanium, a titanium alloy, a stainless, and the other various metal material. As occasion demands, a fiber reinforcing resin or the like can be used in a part or an entire of the head. Although the material is not particularly limited, it is desirable that the head 1 is formed by a titanium alloy. The head 1 in accordance with the present embodiment is structured such that a main portion is formed by a lost wax precision casted product made by an $\alpha+\beta$ type titanium alloy (Ti-6Al-4V). Further, the other parts are welded to the main portion. The manufacturing method and the material of the head can be variously changed.

Figure 4:
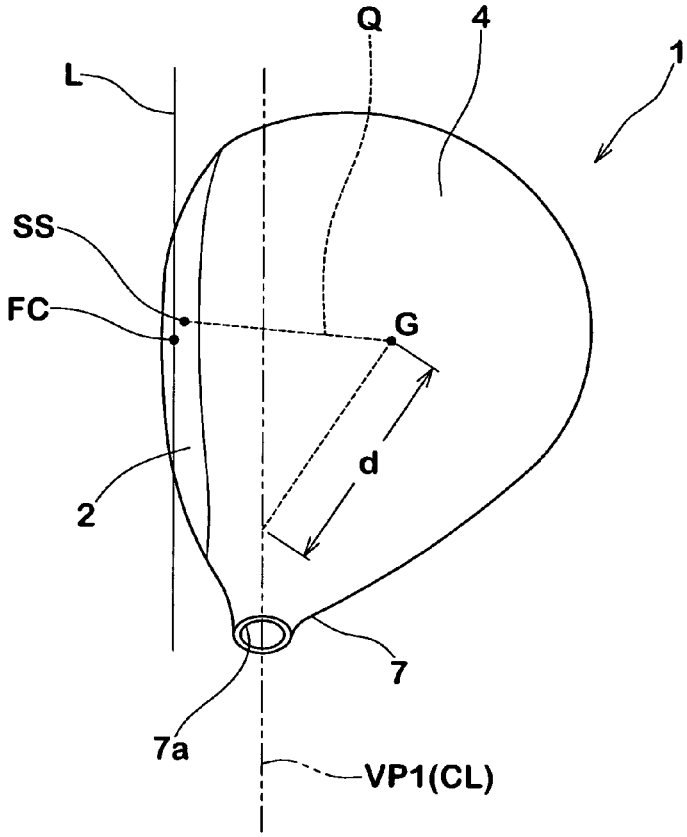
FIG. 4 is a plan view showing the measured state of the head.
Figure 5:
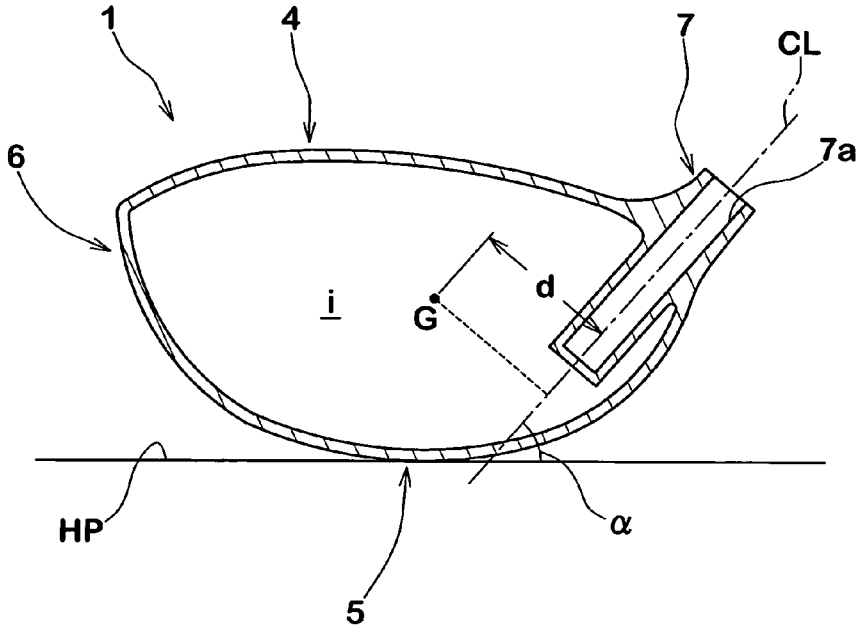
FIG. 5 is an end elevational view in a cut surface in parallel to a vertical plane VP1 in FIG. 4.

Further, the head measured state, that is, a state for performing measurements on the club head, definitely determines a position of the head 1 with respect to a horizontal plane HP. In particular, the center line SL of the shaft axis is arranged within a vertical plane VP1, and is inclined by a lie angle $\beta$ determined in correspondence to the head. Further, the face angle is established at 0 degree, with the club head grounded on the horizontal plane HP. A zero degree face angle is an orientation of the face such that a horizontal tangential line in contact with an area center of gravity FC of the face surface 2 is parallel to the vertical plane VP1, as shown in FIG. 4.

In the head measured state, in the head 1 in accordance with the present invention, a distance d of center of gravity corresponding to a shortest distance between the center line SL of the shaft axis and the center of gravity G of the head is set between 45 and 50 mm.

Figure 6:
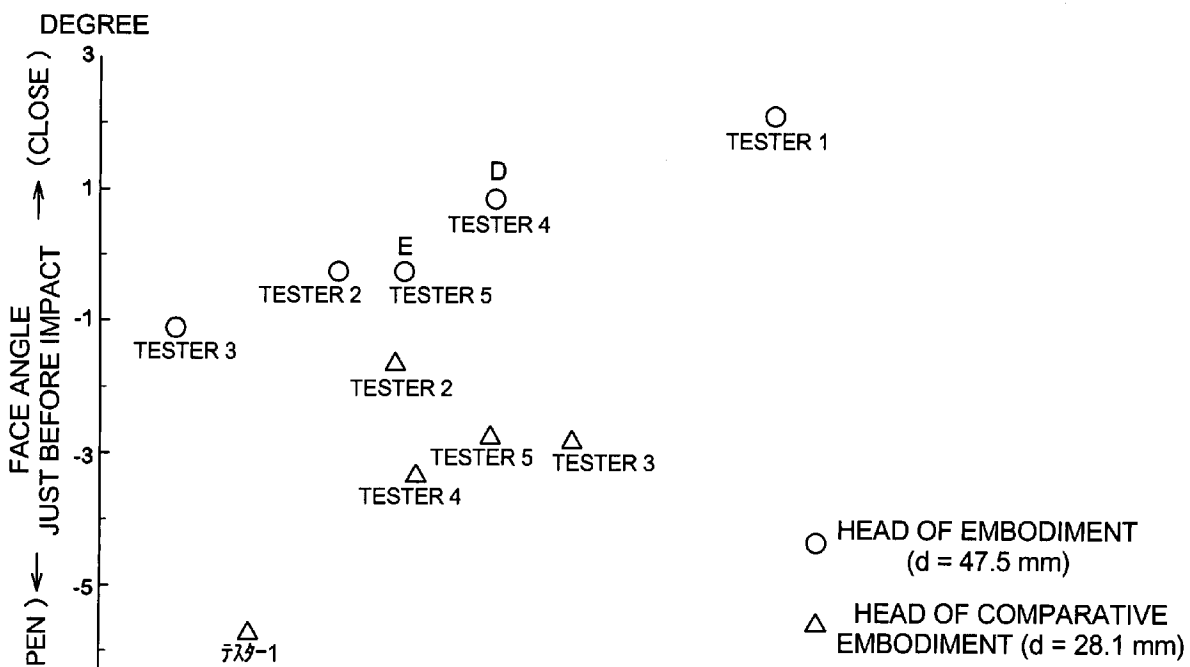
FIG. 6 is a graph showing a change of a face angle during swing.

The inventors give golfers in a beginner and intermediate levels a lot of ball hitting tests. FIG. 6 shows ball hitting results of two kinds of clubs by five golfers (testers 1 to 5), as a representative embodiment. In FIG. 6, a horizontal axis shows a face angle at a position 10 cm before an impact of the ball, and a vertical axis shows a face angle just before the impact, respectively. The face angle is displayed by 0 degree at a time when the face surface is perpendicular to a direction of an aimed target line, minus in the case that the face surface is opened more than the above, and plus in the case that the face surface is closed more than the above.

In all of heads in accordance with comparative embodiments having a center of gravity distance d of 28.1 mm, the face angle just before the impact is large. On the contrary, in the heads in accordance with the present embodiments having a center of gravity distance d of 47.5 mm, the face angle just before the impact is very small in all the testers. Checking in more detail, in the tester 1, it is known that the change of the face angle from the position 10 cm before the impact to the position just before the impact is very small. The tester 1 mentions that the tester 1 feels that the head is turned already at a top position (a position where the head is ascended high) during the swing in the case of the head having a long distance d of center of gravity. Further, the tester 1 feels that the state just before the impact comes as it is.

Figure 11:
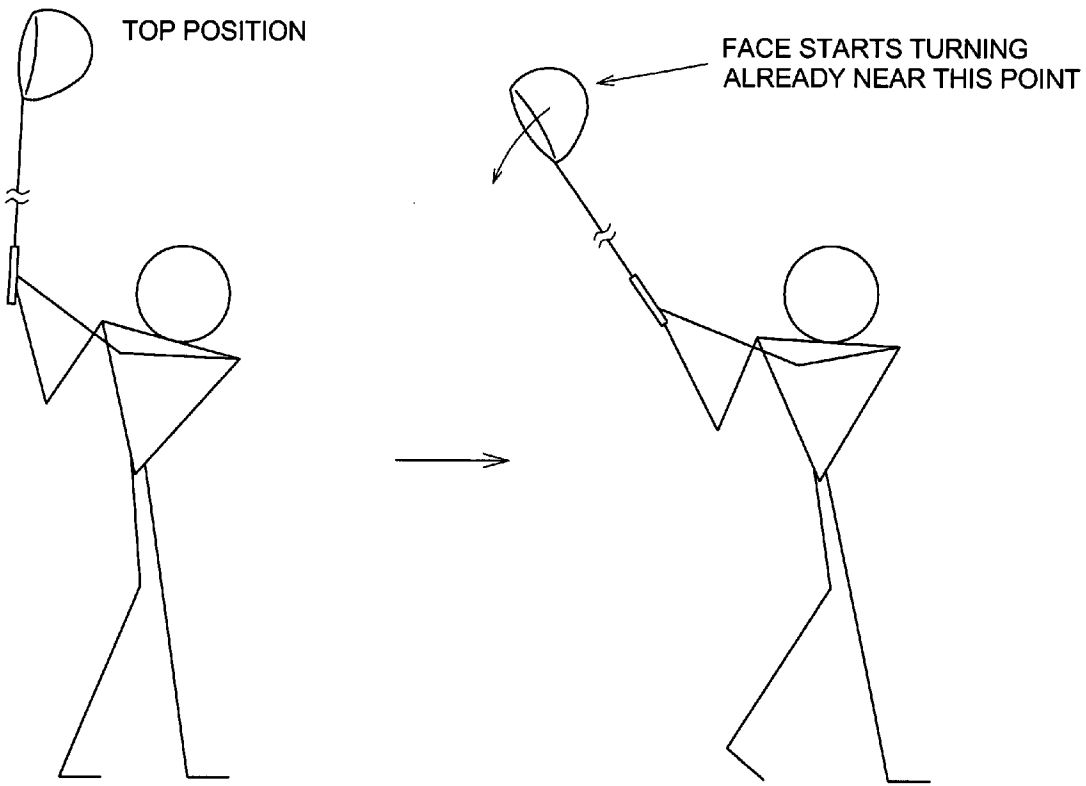
FIG. 11 is a schematic view exemplifying a swing pattern of a tester 1.

As shown in FIG. 11, the swing pattern of the tester 1 is based on a type that a top position is comparatively low and the face surface is early turned. The head having the long distance d of center of gravity has a long leg of moment, and accordingly promotes the turn of the head already from the top position. In other words, a moment of closing the face surface is generated greatly, and the turn is promoted.

On the other hand, the results of the testers 2 to 5 are absolutely different from the tester 1 in the head in accordance with the embodiment. In other words, the face surface is changed greatly in a direction in which the face angle is closed from the position 10 cm before the impact to the position just before the impact. The head having the long distance d of center of gravity has a great moment of inertia around the center line of the shaft axis. Accordingly, in the case of rotating the head around the center line of the shaft axis, it is hard to rotate the head in an initial stage, however, a lowering in rotation speed is reduced once the head starts rotating. This can be considered as a reason of effectively closing the face surface.

Further, checking further more beginner and intermediate golfers, it is known that two swing patterns mentioned above are very frequent in the golfers having the skill level mentioned above. The present invention provides a head in which the distance d of center of gravity is larger than the conventional one, on the basis of the knowledge mentioned above. In accordance with the structure mentioned above, it is possible to prevent the face surface from being opened at a time of impact, and it is possible to reduce the slice spin.

In the case that the distance d of center of gravity is less than 45 mm, the face tends to be opened at a time of impact, as in the head in accordance with the comparative embodiment On the contrary, in the case that the distance d of center of gravity is more than 50 mm the moment of inertia around the center line of the shaft axis becomes excessively great, and the impact is generated after all in a state in which the face surface is opened. The distance d of center of gravity is preferably between 47 and 49 mm and is more preferably between 47 and 48 mm.

The head 1 having the long distance d of center of gravity can be achieved by reviewing a weight distribution design in the head. For example, the weight distribution design is as follows.

(a) Increasing a volume of the head.

(b) Increasing a length of the head in the toe direction and the heel direction.

(c) Making a thickness of the head in the toe side larger than a thickness in the heel side.

(d) Adding a weight to the head in the toe side.

They can be suitably combined.

The head having a greater volume has a greater moment of inertia. Accordingly, even in the case that the impact position is displaced from the sweet spot SS, a deviation of the head is small and a directionality is stable. On the basis of these view points, the head volume is desirably equal to or more than 300 $cm^3$, is more preferably equal to or more than 350 $cm^3$, and is particularly preferably equal to or more than 400 $cm^3$. On the other hand, since the head volume is sufficient within an actually allowably range as the golf club, an upper limit of the head volume is not particularly limited. However, in order to prevent the head weight from being excessively increased and in order to prevent a durability of the head from being lowered, the head volume is set to be equal to or less than 600 $cm^3$, is preferably set to be equal to or less than 550 $cm^3$, is further preferably set to be equal to or less than 500 $cm^3$, is more preferably set to be equal to or less than 450 $cm^3$, and is further preferably set to be equal to or less than 425 $cm^3$. In this case, the neck portion 7 is included in the head volume.

Further, when making the head volume great, an inertia moment Ia around an axis passing through the head center of gravity G in the head measured state and perpendicular to the horizontal plane HP, and an inertia moment 1*b* around an axis passing through the head center of gravity and parallel to the horizontal plane HP and the vertical plane VP1 become great. On the other hand, the head weight is exposed to a certain constraint in view of a swing balance. Accordingly, for example, in the case that the head volume is equal to or more than 300 $cm^3$ and less than 350 $cm^3$, it is desirable that the inertia moment Ia is equal to or more than 2800 g□$m^2$ and the inertia moment Ib is equal to or more than 1700 g□$m^2$, in the case that the head volume is equal to or more than 350 $cm^3$ and less than 400 $cm^3$, it is desirable that the inertia moment Ia is equal to or more than 3400 g□$m^2$ and the inertia moment Ib is equal to or more than 2000 g□$m^2$, and in the case that the head volume is equal to or more than 400 $cm^3$, it is desirable that the inertia moment Ia is equal to or more than 3800 g□$m^2$ and the inertia moment Ib is equal to or more than 2700 g□$m^2$.

Further, it is desirable that the face bulge and the face roll is connected with the head volume (in other words, the inertia moments Ia and Ib). The face bulge corresponds to a radius of curvature of the face surface 2 cut by the horizontal plane passing through the area center of gravity FC of the face surface 2 in the head measured state. Further, the face roll corresponds to a radius of curvature of the face surface 2 cut by a vertical plane passing through the area center of gravity FC of the face surface 2 and perpendicular to the vertical plane VP on which the center line SL of the shaft axis is positioned.

Figure 7:
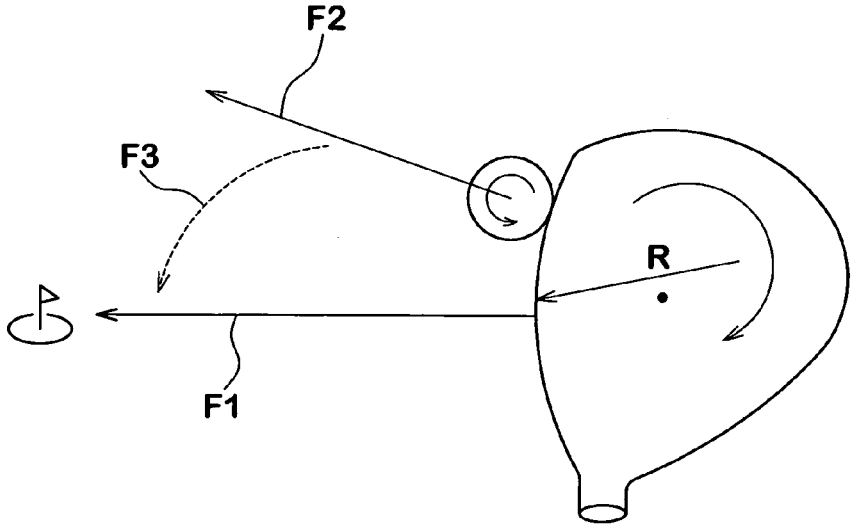
FIG. 7 is a plan view describing a relation between a gear effect and a face bulge.
Figure 8A:
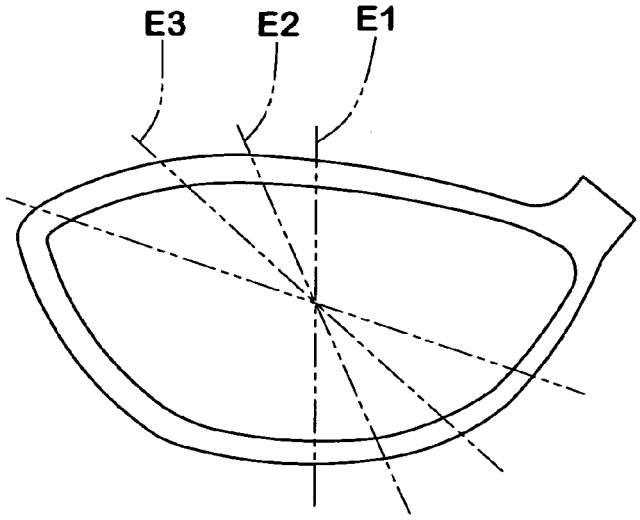
FIG. 8A is a front elevational view describing the face surface.
Figure 8B:
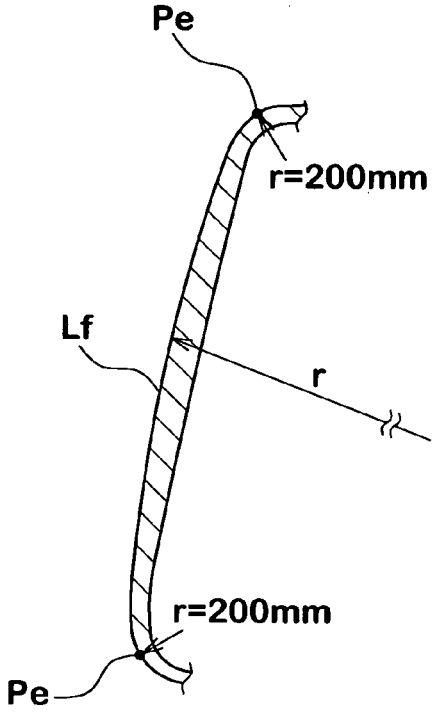
FIG. 8B is a cross sectional view of FIG. 8A.

When making the head volume greater, the inertia moments Ia and Ib are made greater as mentioned above. This makes an effect of a spin amount of the ball obtained by the gear effect small. On the other hand, the face bulge and the face roll control a flying angle of the ball just after being hit, in correspondence to the spin generated by the gear effect. For example, as shown in FIG. 7, in the head having the face surface 2 provided with the face bulge having a radius R of curvature, the ball is hit out to a right side from an aimed direction F1 in the case of being hit by the toe side. However, since a hook spin caused by the gear effect is applied to the ball, the hit ball is curved toward the aimed direction as shown by an arrow F3 and the deviation from the aimed direction can be reduced.

As mentioned above, the face bulge controls the lateral flying angle of the ball just after being hit, and stabilizes a directionality of the hit ball in accordance with a synergetic effect with the gear effect. With respect to the face roll, the effect mentioned above appears in a vertical direction. Accordingly, it is preferable that the face bulge and the face roll (hereinafter, sometimes refer collectively to "face round") are defined by making a connection with the gear effect, in other words, are defined by making a connection with the head volume.

In particular, in the case that the head volume is equal to or more than 300 $cm^3$ and less than 350 $cm^3$, it is desirable that the radius of curvature of the face round is between 229 and 330 mm, and is more preferably between 254 and 305 mm. Further, in the case that the head volume is equal to or more than 350 $cm^3$ and less than 400 $cm^3$, it is desirable that the radius of curvature of the face round is between 254 and 356 mm, and is more preferably between 267 and 330 mm. Further, in the case that the head volume is equal to or more than 400 $cm^3$, it is desirable that the radius of curvature of the face round is between 279 and 381 mm, and is more preferably between 292 and 356 mm. In this case, an area close to an edge of the face surface 2 may be out of a range of the radius of curvature of the face round.

In this case, in the head having the long distance d of center of gravity, the center of gravity G of the head tends to move close to the toe side, and the sweet spot SS (a point at which a perpendicular line Q dropped from the center of gravity G of the head to the face surface 2 intersects the face surface 2) is positioned close to the toe by extension. However, since the golfer can not normally know a position where the sweet spot SS exists on the face surface 2, the golfer tries to hit the ball by a center of the face surface 2. Accordingly, in the case that the distance d of center of gravity is only made longer, the ball is hit by the position close to the heel rather than the sweet spot SS, and there is a risk that the slice spin is generated due to the reason (3) mentioned above.

Figure 2:
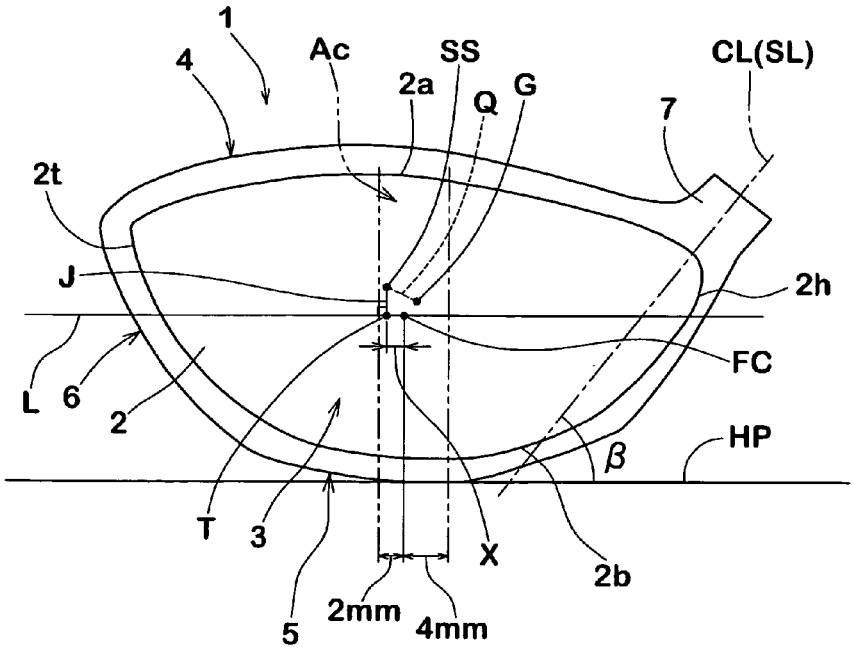
FIG. 2 is a front elevational view showing a measured state of the head.
Figure 3:
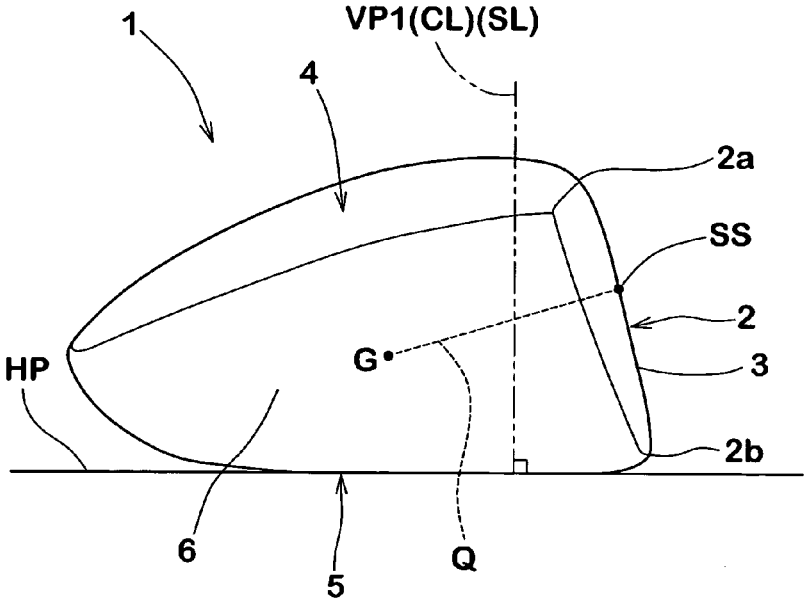
FIG. 3 is a side elevational view showing the measured state of the head.

As shown in FIGS. 2 and 4, in accordance with the present invention, a point T on which the horizontal tangential line passing through the area center of gravity FC of the face surface and being in contact with the face surface intersects the perpendicular line dropped from the sweet spot SS to the tangential line is provided in a face surface center area Ac which is within 2 mm close to the toe side from the area center of gravity FC and within 4 mm close to the heel side on the tangential line. Accordingly, it is possible to substantially coincide the aimed hitting point of the golfer with the sweet spot SS, and it is possible to prevent the slice spin from being generated.

Further, in the case that the point T exists close to the toe side rather than the area center of gravity FC, if a distance therebetween is longer than 2 mm, the ball tends to be hit by a position which is largely deviated from the sweet spot SS to the heel side. Accordingly, as the reason (3) mentioned above, the slice spin tends to be generated by the gear effect, and the directionality is deteriorated. On the contrary, in the case that the point T exists close to the heel side rather than the area center of gravity FC, if the distance therebetween is longer than 4 mm, the ball tends to be hit by a position which is largely deviated from the sweet spot SS to the toe side. In this case, the hook spin tends to be generated by the gear effect, and the directionality is deteriorated in the same manner.

One of objects of the present invention is to reduce the slice spin. Accordingly, it is important to reduce a probability by which the ball is hit by the heel side rather than the sweet spot SS. Therefore, an allowable amount in the toe side of a length x on the tangential line L is 2 mm, however, that in the heel side is twice, 4 mm. This allows that the head center of gravity G is close to the heel. More preferably, the range of the length x mentioned above is 1 mm in the toe side and 2 mm in the heel side. Further preferably, it is desirable that the range of the length x is 0 mm in the toe side and 1.5 mm in the heel side.

It is desirable that the head 1 in accordance with the present invention is applied to a head having a loft angle between 7 and 12 degree, more preferably having the loft angle between 10.5 and 12 degree mainly for an average golfer, and more particularly having the loft angle between 11 and 12 degree.

EMBODIMENT

Examples

Wood type golf clubs having basic aspects shown in FIGS. 1 to 5 are manufactured by way of trial on the basis of the specification in Table 1. Each of the heads is manufactured by welding a face plate formed by a material Ti-4.5Al-3V-2Mo-2Fe to a head main body casted from a material Ti-6Al-4V. Further, the specification of each of the heads is as follows.

Loft angle: 11 degree

Face angle: 2 degree

Lie angle: 56 degree

Mass of head: 188 g

Radius of curvature of face bulge and face roll: 254 mm

The same carbon shaft (MP-100 Flex R manufactured by Sumitomo Rubber Industries, Ltd.) is attached to the heads, and the wood type golf clubs having an entire length 45 inch and a balance D0 are manufactured by way of trial. Each of the clubs is evaluated in accordance with a ball hitting test. of impact, a lateral deviation amount of a point of fall of the hit ball with respect to the aimed direction is measured. The deviation amount is obtained as an average value. In the case that the hit ball is deviated in a left direction, the deviation amount is displaced by a minus value, and the deviation in a right direction is displaced by a plus value. Further, a moment of inertia of the head is measured by an apparatus MOMENT OF INERTIA MEASURING INSTRUMENT manufactured by INERTIA DYNAMICS Inc. Further, there is executed an impression test of checking whether or not an uncomfortable feeling exists in a head shape at a time of address, and evaluating in accordance with the number of the golfers who feel odd. Results of the test and the like are shown in Table 1 and Table 2.

TABLE 1

| | Ex. 1 | Ex. 2 | Ex. 3 | Ex. 4 | Ex. 5 | Ex. 6 | Ex. 7 |
|---|---|---|---|---|---|---|---|
| Distance (x) [mm] (*1) | 0 | 0 | −1.8 | +3.9 | +3.8 | −1.9 | −1.1 |
| Distance of center of gravity (d) [mm] | 47.5 | 47.6 | 45.1 | 45.2 | 49.8 | 49.8 | 48.2 |
| Head Volume [$cm^3$] | 350 | 470 | 350 | 350 | 350 | 350 | 350 |
| Inertial Moment (Ia) [$g \cdot cm^2$] | 3550 | 4510 | 3480 | 3500 | 3750 | 3790 | 3700 |
| Inertial Moment (Ib) [$g \cdot cm^2$] | 2120 | 2980 | 2040 | 2080 | 2430 | 2470 | 2410 |
| Amount of gaps of fall point of golf ball (avg.) [m] (*2) | −2.0 | −1.8 | +2.1 | −5.1 | −5.8 | +1.3 | −0.2 |
| Feeling test (Number which felt sense of incongruity ) | Five or less | Five or less | Five or less | 48 | 45 | Five or less | Five or less |

TABLE 2

| | Ex. 8 | Ex. 9 | Ex. 10 | Ref. 1 | Ref. 2 | Ref. 3 | Ref. 4 | Ref. 5 |
|---|---|---|---|---|---|---|---|---|
| Distance (x) [mm] (*1) | −1.0 | +2.1 | +2.0 | 0 | +0.1 | −3.0 | +4.9 | 0 |
| Distance of center of gravity (d) [mm] | 46.9 | 48.0 | 46.7 | 52.2 | 42.5 | 47.5 | 47.6 | 28.1 |
| Head Volume [$cm^3$] | 350 | 350 | 350 | 350 | 350 | 350 | 350 | 350 |
| Inertial Moment (Ia) [$g \cdot cm^2$] | 3530 | 3680 | 3520 | 3990 | 3400 | 3600 | 3590 | 2820 |
| Inertial Moment (Ib) [$g \cdot cm^2$] | 2100 | 2360 | 2090 | 2710 | 1980 | 2150 | 2100 | 1540 |
| Amount of gaps of fall point of golf ball (avg.) [m] (*2) | +0.4 | −3.5 | −3.0 | +5.2 | + 6.8 | +7.5 | −5.3 | + 13.8 |
| Feeling test (Number which felt sense of incongruity ) | Five or less | Five or less | Five or less | Five or less | Five or less | Five or less | 88 | Five or less |

(*1) Plus value shows when a sweet spot is in the heel side rather than a area center of gravity of face. Minus value shows when a sweet spot is in the toe side rather than the area center of gravity of the face.

(*2) Plus value shows the gap on right-hand side to the direction of a target. Minus value shows the gap on left-hand side to the directio n of the target.

In each of the heads, the head center of gravity is adjusted by changing the thickness of the head in the toe side and the heel side. A lower limit of the thickness is 0.8 mm. Further, an upper limit of the thickness is 1.6 mm in the embodiment 2, and is 2.2 mm in the other embodiments.

A ball hitting test is performed by a hundred of right-handed golfers each having a handicap equal to or more than 15. The content is that each of the golfers actually hits ten golf balls ("MAXFLI HI-BRID" manufactured by Sumitomo Rubber Industries, Ltd.) by using each of the trial clubs. In order to measure a state of the head turn at a time The embodiment 1 is best balanced, the point of fall is in a left direction with respect to the aimed direction, and a good result is obtained. In the embodiment 2, the distance x is the same as that of the embodiment 1, however, the head volume is great. Accordingly, the dispersion is smaller. In this case, in the embodiments 1 and 2, average values of absolute values of the deviation amounts of all the hit balls are respectively 12.8 m and 5.2 m. In accordance with this matter, it is known that the embodiment 2 is advantageous.

In the embodiment 3, the distance x is minus, that is, the sweet spot exists close to the toe side rather than the area center of gravity. Accordingly, the slice spin caused by the gear effect tends to be slightly applied and the point of fall is close to the right side, however, the amount of displacement itself is smaller than the comparative embodiment. Further, in the embodiment 4, the distance x is plus, that is, the sweet spot is close to the heel side rather than the area center of gravity. Accordingly, the hook spin tends to be slightly applied due to the little gear effect, and the point of fall is close to the left side. This is a satisfactory result. In the embodiment 5, the distance x is approximately the same as that of the embodiment 4, however, the distance d of center of gravity is slightly longer. Further, in the embodiment 6, the sweet spot is close to the toe side. Actually, the slice spin tends to be generated, however, since the distance d of center of gravity is long and the head tends to be turned, the amount of displacement is small.

Figure 9:
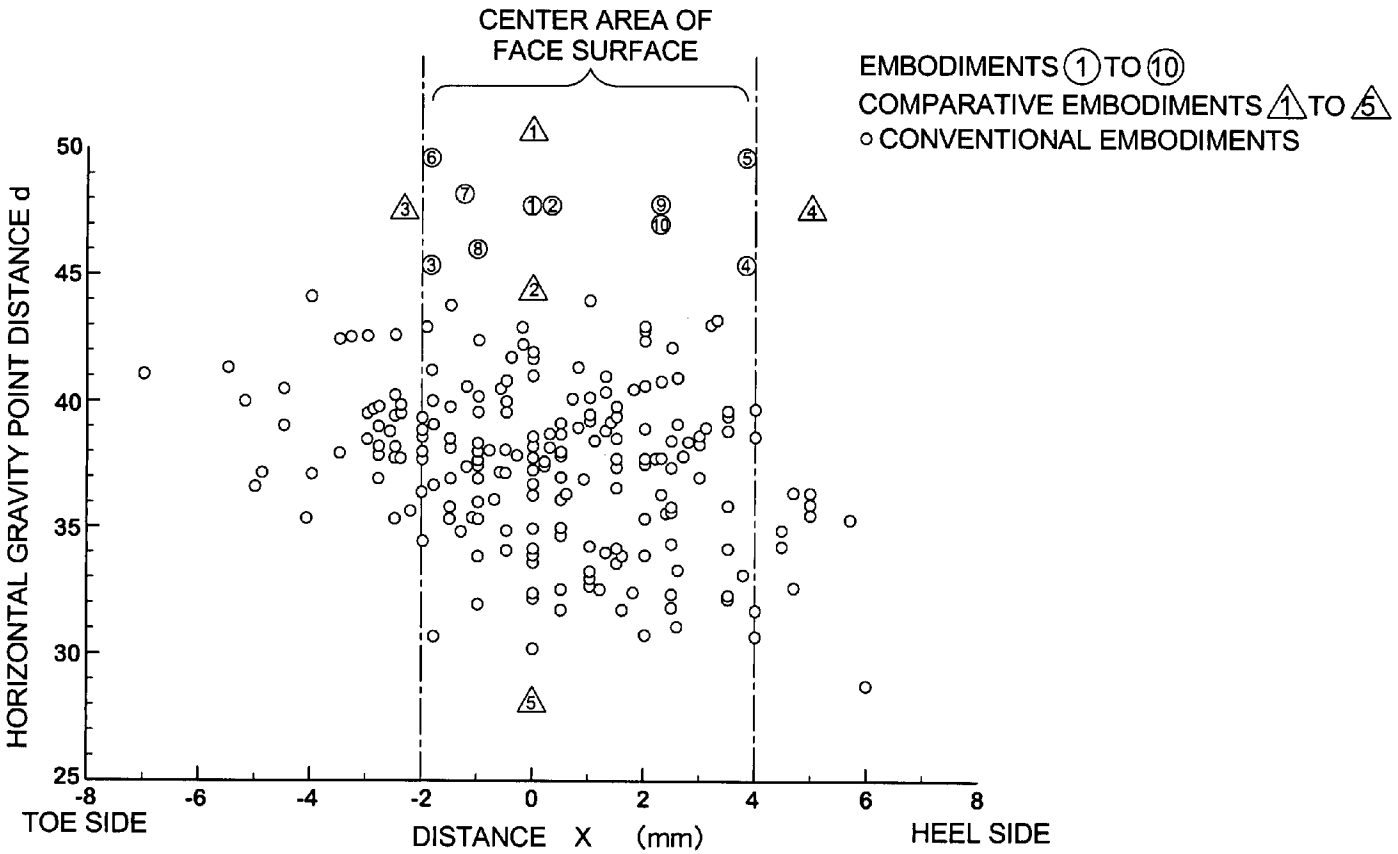
FIG. 9 is a graph showing a distribution of the distance d of center of gravity of the head.
Figure 10A:
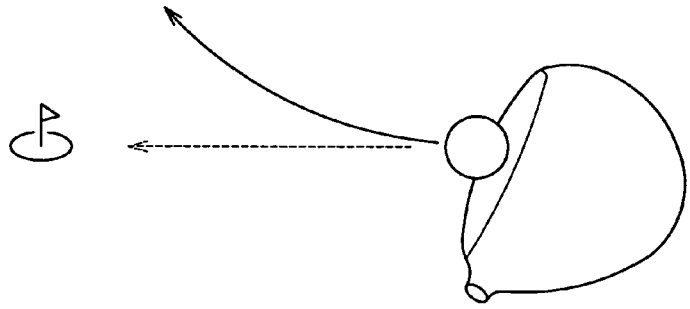
FIGS. 10A, 10B and 10C are plan schematic views describing a reason of a slice spin.
Figure 10B:
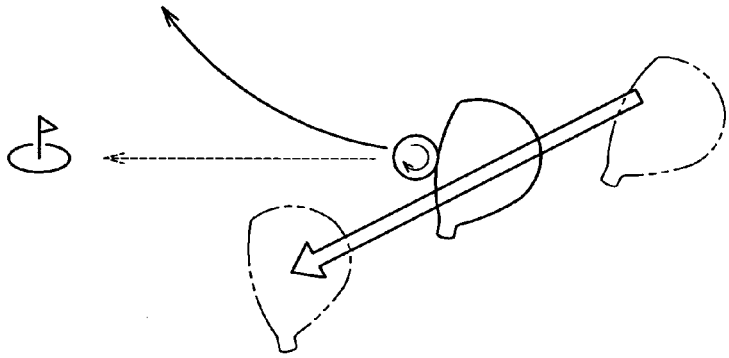
Figure 10C:
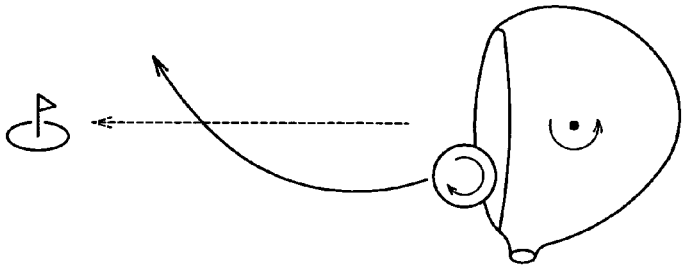

Since the distance d of center of gravity is too long in the comparative embodiment 1, and the distance d of center of gravity is too short in the comparative embodiment 2, the amount of displacement in the right direction is larger in both cases. In the comparative embodiment 3, since the distance x is short although the distance d of center of gravity is proper, the hit ball is deviated largely in the right direction due to the effect of the slice spin caused by the gear effect. In the comparative embodiment 4, since the distance x is too long, the amount of displacement in the left direction is large due to the hook spin caused by the gear effect. FIG. 9 shows a relation between the distance x and the distance d of center of gravity including the conventional head and the head in accordance with the comparative embodiment.

The head in accordance with the present invention improves the turn at a time of swing. Further, it is possible to coincide the hitting point with the sweet spot. Accordingly, it is possible to reduce the slice spin of the hit ball and it is possible to improve the directionality of the hit ball. Further, since the turn of the head is improved, the average golfer can easily hit a so-called draw strong ball and can improve a carry.

The invention claimed is:

1. A wood-type club head having (1) a center of gravity (G) defined by the distribution of weight in the club head, (2) a face with a sweet spot (SS) located where the face is intersected by a line perpendicular to the face extending through the center of gravity (G) of the club head, (3) a toe, (4) a heel and (5) a neck with a shaft insertion hole defining a shaft axis, wherein, in a state of the club head for performing measurements on the club head, the shaft axis is inclined at a set lie angle with respect to a horizontal plane and lies in a vertical plane, and a horizontal line tangent to the face at an area center of gravity (FC) of the face is parallel to the vertical plane, and wherein:

the volume of the club head is in the range of from 350 $cm^3$ to 500 $cm^3$;

a distance (d) corresponding to a shortest distance between the shaft axis and the center of gravity (G) of the club head is in the range of from 45 mm to 50 mm;

a point (T) at which the horizontal line is intersected by a perpendicular line extending from the sweet spot (SS) of the face is located away from the area center of gravity (FC) and within 4 mm from the area center of gravity (FC) in the direction toward the heel.

2. A wood type golf club head as claimed in claim 1, wherein said distance (d) is between 47 and 48 (mm).

3. A wood-type club head according to claim 1, wherein the face has a face bulge having a radius of curvature in the range of from 254 mm to 356 mm.

4. A wood-type club head according to claim 1, wherein the face has a face roll having a radius of curvature in the range of from 254 mm to 356 mm.

5. A wood-type club head according to claim 1, wherein the face has a face bulge and a face roll each having a radius of curvature in the range of from 254 to 356 mm.

6. A wood-type club head according to claim 1, wherein the club head comprises a bead main body and a face plate attached to the head main body, the main body is composed of titanium alloy of Ti-6Al-4V; and the face plate is composed of titanium alloy of Ti-4.5Al-3V-2Mo-2Fe.

7. A wood-type club head according to claim 1, wherein a moment of inertia around the normal axis passing through the center of gravity of the club head is not less than 3400 $g \cdot cm^2$, and a moment of inertia around the axis passing through the center of gravity of the club head and parallel to both the horizontal plane and the vertical plane is not less than 2000 $g \cdot cm^2$.

8. A wood-type club head having (1) a center of gravity (G) defined by the distribution of weight in the club head, (2) a face with a sweet spot (SS) located where the face is intersected by a line perpendicular to the face extending through the center of gravity (G) of the club head, (3) a toe, (4) a heel and (5) a neck with a shaft insertion hole defining a shaft axis, wherein, in a state of the club head for performing measurements on the club head, the shaft axis is inclined at a set lie angle with respect to a horizontal plane and lies in a vertical plane, and a horizontal line tangent to the face at an area center of gravity (FC) of the face is parallel to the vertical plane, and wherein:

the volume of the club head is in the range of from 350 $cm^3$ to 500 $cm^3$;

a distance (d) corresponding to a shortest distance between the shaft axis and the center of gravity (G) of the club head is in the range of from 45 mm to 50 mm;

a point (T) at which the horizontal line is intersected by a perpendicular line extending from the sweet spot (SS) of the face is located within 2 mm from the area center of gravity (FC) in the direction toward the toe and within 4 mm from the area center of gravity (FC) in the direction toward the heel;

the toe and heel each has a thickness being in the range of from 0.8 mm to 2.2 mm; and the thickness of the toe is larger than the thickness of the heel.

9. A wood-type club head according to claim 8, wherein a moment of inertia around the normal axis passing through the center of gravity of the club head is not less than 3400 $g \cdot cm^2$, and a moment of inertia around the axis passing through the center of gravity of the club head and parallel to both the horizontal plane and the vertical plane is not less than 2000 $g \cdot cm^2$.

10. A wood-type club head according to claim 8, wherein said distance (d) is between 47 and 48 (mm).

11. A wood-type club head according to claim 8, wherein the face has a face bulge having a radius of curvature in the range of from 254 mm to 356 mm.

12. A wood-type club head according to claim 8, wherein the face has a face roll having a radius of curvature in the range of from 254 mm to 356 mm.

13. A wood-type club head according to claim 8, wherein the club head comprises a head main body and a face plate attached to the head main body, the main body is composed of titanium alloy of Ti-6Al-4V; and the face plate is composed of titanium alloy of Ti-4.5Al-3V-2Mo-2Fe.

14. A wood-type club head according to claim 8, wherein the point (T) is located away from the area center of gravity (FC) in the direction toward the heel.

* * * * *